United States Patent [19]

Melville

[11] 3,965,549

[45] June 29, 1976

[54] MANUFACTURE OF SOLID METAL SPHERICAL ARTICLES

[75] Inventor: William Melville, Handsworth, England

[73] Assignee: Imperial Metal Industries (Kynoch) Limited, Birmingham, England

[22] Filed: Oct. 18, 1974

[21] Appl. No.: 516,017

[30] Foreign Application Priority Data

Oct. 31, 1973 United Kingdom ..... 50607/73

[52] U.S. Cl. ..... 29/1.22; 29/148.4 B

[51] Int. Cl.[2] ..... B21K 21/06

[58] Field of Search ..... 29/1.22, 148.4 B; 51/313, 164; 241/182

[56] References Cited

UNITED STATES PATENTS

| | | | |
|---|---|---|---|
| 2,313,876 | 3/1943 | Jelinek | 29/148.4 B |
| 2,758,360 | 8/1956 | Shetler | 29/148.4 B X;1.22 |
| 2,807,020 | 9/1957 | Schell | 51/313 |
| 2,946,115 | 7/1960 | Firm | 29/148.4 B |
| 3,204,320 | 9/1965 | Ekstein et al. | 29/148.4 B |

*Primary Examiner*—Othell M. Simpson
*Assistant Examiner*—Leon Gilden
*Attorney, Agent, or Firm*—Cushman, Darby & Cushman

[57] ABSTRACT

Method and apparatus for making lead shot by barrel tumbling a charge of non-spherical preforms in a liquid coolant, involving the evaporation and condensing of the coolant while the preforms are progressively deformed to spherical shape.

9 Claims, 4 Drawing Figures

MANUFACTURE OF SOLID METAL SPHERICAL ARTICLES

BACKGROUND OF THE INVENTION

This invention relates to the manufacture of solid metal spherical articles. The invention is particularly applicable to the manufacture of lead shot for shotgun cartridges, more particularly the larger or heavier gauge shot, but is also suitable for other products such as spherical lead weights for fishing tackle, for example.

Small gauge lead shot is produced by allowing droplets of liquid lead to fall under gravity down a so-called shot tower into water. However, for larger sizes of shot, for example 0.2 inch diameter, the shot tower process is not practicable because the surface tension of the shot material breaks down. For the larger sizes of shot, methods employed have involved mechanically forming each part in a mould.

In order to provide spherical lead shot, experiments have been carried out to tumble in a barrel a quantity of lead preforms in the shape of short lengths severed from a wire. The experiments were generally satisfactory for small quantities of shot although a long cycle time, in excess of ten hours, was required. This was uneconomic for commercial requirements.

SUMMARY OF THE INVENTION

According to the present invention, a method of manufacturing solid spherical articles comprises tumbling a charge of initially non-spherical deformable preforms with a quantity of liquid coolant in a rotating barrel, the liquid having an evaporation temperature below the softening temperature of the material of the preforms so that the liquid is heated to its evaporation temperature by the tumbling action of the preforms, allowing the distillate to condense and return to the preforms, and continuing the process until the preforms are deformably reshaped by their tumbling action to spherical articles.

The choice of liquid coolant will depend upon the material of the preforms; for lead preforms a suitable coolant is water, but the cycle time for the process may be reduced by employing ethylene glycol as the coolant.

Conveniently, the distillate is condensed in a heat exchange chamber of the barrel located above the charge of preforms. Advantageously, the condensation is assisted by the provision of heat exchange elements on the exterior of the condensation chambers.

According to the invention also, an apparatus for the manufacture of solid spherical articles comprises a rotatable barrel, external heat exchange elements carried by the barrel in heat exchange relationship therewith and located on part of the barrel which serves, in use, as a condensation chamber.

Preferably, means are provided on the inner surface of the barrel to promote tumbling of articles therein.

The tumbling promoting means may be a roughened surface produced by shot blasting the surface of the barrel; alternatively, fins or ridges may be disposed on the inner surface.

The barrel may be mounted for rotation about a horizontal, vertical or intermediate axis.

The external heat exchange elements are preferably provided as a plurality of circumferentially extending fins spaced apart axially of the barrel on a hollow end cap of the barrel.

Advantageously, a vent is provided in the barrel, conveniently in the end wall of the cap.

Preferably, a plurality of barrels as defined above are mounted for rotation about axes which are eccentric of, and revolvable about a common axis.

BRIEF DESCRIPTION OF THE DRAWINGS

One embodiment of the invention will now be described by way of example only, with reference to the accompanying drawings, in which.

DESCRIPTION OF THE PREFERRED EMBODIMENT

Figure 1:
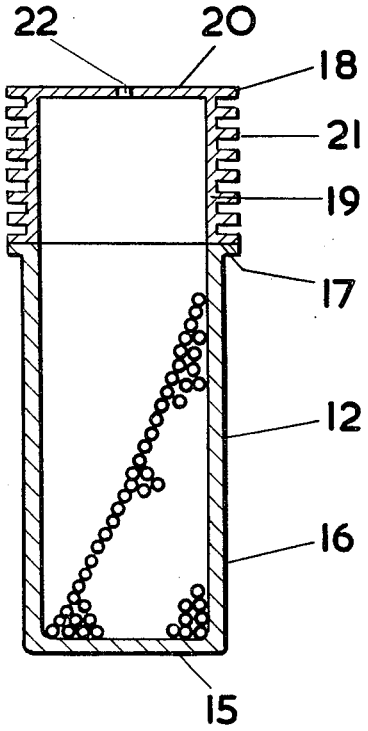
FIG. 1 is an axial cross-sectional view of a barrel.
Figure 2:
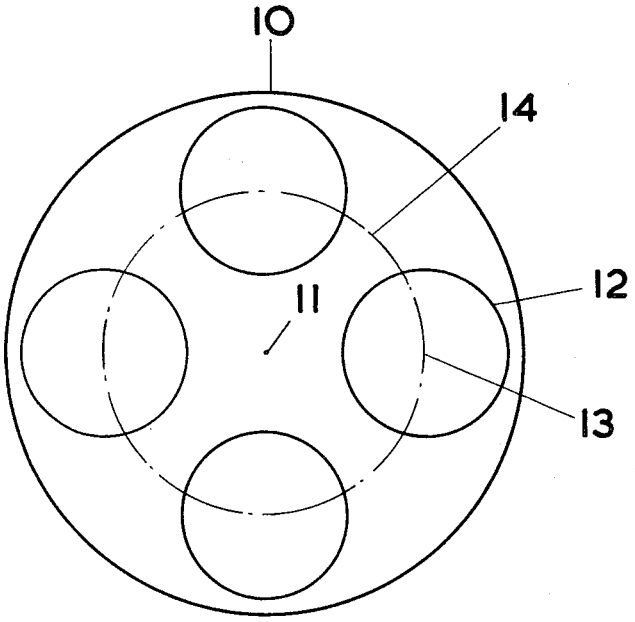
FIG. 2 is a diagrammatic plan view of an apparatus employing four barrels.

Referring initially to FIGS. 1 and 2 of the drawings, an apparatus for the manufacture of solid spherical articles comprises a base 10 mounted for rotation about a vertical axis 11 in an anti-clockwise direction.

Four steel barrels 12 are carried by the base 10 and are mounted for rotation about respective vertical axes 13 in a clockwise direction. The axes 13 are located on a pitch circle 14 of which the centre is coincident with the axis 11 and are spaced at equal intervals around the circle 14. The drive mechanism for the relative rotation of the base and barrels is not described since the apparatus so far described is commercially available as planetary ball mills employed for grinding or milling material.

Each barrel 12 comprises a base 15 and an upstanding wall 16 having an external flange 17 at its upper free end. The inner surface of the wall 16 has a shot-blast finish. The barrel is closed by a hollow end cap 18 releasably secured to the flange 17. The end cap is made from aluminium alloy and is of inverted cup-shape comprising a side wall 19 and an end wall 20. The side wall is machined to provide a series of circumferentially extending fins 21 which are spaced apart axially of the barrel, the fins thus being integral with the end cap. A vent 22 is provided as a small hole in the end wall 20.

Figure 3:
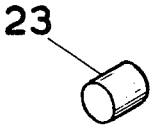
FIG. 3 is a perspective view of a typical preform.
Figure 4:
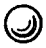
FIG. 4 is a perspective view of a finished article produced from the preform of FIG. 3.

A typical use of the apparatus is to produce large lead shot for shotgun cartridges, the shot being of lead/1⅛% antimony composition. Preforms 23 shown in FIG. 3 of the drawings are made by severing circular section lead alloy wire into individual short lengths. A charge, typically 601*b* of these non-spherical preforms is loaded into each of the barrels 12, together with 3 cu in of water and the apparatus set in motion at such rotational speeds that the rotation of the base 10 imparts centrifugal force to the charge of preforms in each barrel thereby maintaining the charge pressed against the wall of the barrel, and rotation of the barrels causes a tumbling action of the preforms. This tumbling action in each barrel generates heat which causes the water to evaporate and rise into the end cap 18. The fins 21 moving through air under the combined rotational and planetary movement of the barrels serve as heat exchange elements and maintain the temperature of the end cap sufficiently low that the cap serves as a condensation chamber whereby the distillate condenses and falls back onto the charge of preforms. After about 1½ hours, it is found that the preforms have been deformed and reshaped to spherical shot.

In modifications of the above described process, liquid coolants other than water may be employed having a higher boiling temperature than water provided that such temperature is below the softening temperature of the preform material. In the case of the above lead alloy having a melting temperature of 317°C, a suitable liquid coolant is ethylene glycol having a boiling temperature of 197°C. Alternatively, the barrels may be operated under internal pressure in which case the vent would be omitted in the end cap.

Apart from lead shot for shotgun cartridges, the invention may be used for producing spherical lead weights for fishing tackle, for example.

I claim:

1. A method of manufacturing solid spherical articles from initial non-spherical preforms of a material which permits deforming of the preforms, comprising tumbling a charge of such preforms with a quantity of liquid coolant in a rotating barrel, the liquid having an evaporation temperature below the softening temperature of the material of the preforms so that the liquid is heated to its evaporation temperature by the tumbling action of the preforms, condensing the resulting vapor and returning the distillate to the preforms, and continuing the process until the preforms are deformably reshaped by their tumbling action to spherical articles.

2. A method as claimed in claim 1 wherein said coolant is water.

3. A method as claimed in claim 1 wherein said coolant is ethylene glycol.

4. A method as claimed in claim 1 wherein the spherical articles are made of lead.

5. A method as claimed in claim 1 wherein the coolant vapor is condensed in a heat exchange chamber of the barrel.

6. A method as claimed in claim 1 wherein the preforms are obtained by severing them from wire.

7. A method as claimed in claim 1 wherein the preforms are substantially cylindrical.

8. A method as claimed in claim 1 wherein the rotary motion of the barrel comprises a planetary rotation about an external axis.

9. A method of manufacturing solid spherical articles from initial non-spherical preforms of a material which is deformable by tumbling, said method comprising: placing a plurality of such preforms in an enclosure together with a liquid coolant which has a boiling temperature at the pressure in the enclosure below the softening temperature of the material of the preforms; rotating the enclosure to tumble the preforms and cause deformation thereof thereby generating heat and evaporating at least a portion of the liquid coolant; flowing the coolant vapor to a heat exchange zone; condensing the coolant vapor by removing heat therefrom in the heat exchange zone and returning the condensate to the preforms; and continuing the process until the preforms are deformably reshaped by the tumbling action to spherical articles.

* * * * *